US006450665B1

(12) United States Patent
Cheng

(10) Patent No.: US 6,450,665 B1
(45) Date of Patent: Sep. 17, 2002

(54) WIRING DEVICE OF DECORATION LIGHT STRING

(76) Inventor: Eden Cheng, No. 60, Lane 68, Nan-Chung St., Hsin-Chu City (TW)

( * ) Notice: Subject to any disclaimer, the term of this patent is extended or adjusted under 35 U.S.C. 154(b) by 0 days.

(21) Appl. No.: 09/696,840

(22) Filed: Oct. 26, 2000

(51) Int. Cl.[7] ..... F21V 21/00; F21S 4/00
(52) U.S. Cl. ..... 362/249; 362/252
(58) Field of Search ..... 362/249, 252, 362/391, 227

(56) References Cited

U.S. PATENT DOCUMENTS 4,654,766 A * 3/1987 Tung ..... 362/249
6,106,138 A * 8/2000 Wei ..... 362/252
6,149,284 A * 11/2000 Wang ..... 362/249
6,217,193 B1 * 4/2001 Won ..... 362/249

* cited by examiner

*Primary Examiner*—Alan Cariaso
(74) *Attorney, Agent, or Firm*—Bucknam and Archer

(57) ABSTRACT

A wiring device comprises a plurality sets of lamp string, each of which being a serial connection of a plurality of lamp sockets via conductive wire, the plurality sets of lamp string being arranged in parallel and are connected to each other at sides via conductive wires; a plurality of high pull-resist auxiliary cords, arranged parallel to each other and serially connect with the hook element on the side of socket in each lamp string in a direction perpendicular to the lamp string to form a interconnected net structure; and a plurality of hatch cylinder holder, having a center receiving space and a side-wall receiving space, the center receiving space clipping a socket on the side of auxiliary cord, and the side-wall receiving space firmly fixing the side of the auxiliary to enhance said net structure.

5 Claims, 4 Drawing Sheets

WIRING DEVICE OF DECORATION LIGHT STRING

FIELD OF THE INVENTION

The present invention relates to a wiring device of Christmas lamp, especially to a net structure formed from interconnecting a plurality of auxiliary cords and lamp strings, both ends of said auxiliary cords being held by a hatch cylinder holder, which clips a side-end socket and firmly fixes the side-end of said auxiliary cord to enhance said net structure.

BACKGROUND ART

It usually takes relative long time to cover a large area from conventional Christmas lamp string, therefore the industry has setup a net cell structure for the conductive wire between lamp strings and then connect such cells to cover a large area to facilitate customer's usage. There is an example described in U.S. Pat. No. 5,669,707 of title "CHRISTMAS LAMP SOCKET". It has proposed to extend a wire in the first set of wire from a socket to a corresponding socket in the second set of wire and return to a successive socket in the first set of wire via hook elements to form a net structure, as shown in FIG. 5. There is another example described in U.S. Pat. No. 5,697,698 of title "CHRISTMAS LAMP SOCKET". It has proposed to lock a conductive wire perpendicular to the lamp string and parallel connects sockets in two tubular portions on opposite sides of sockets to form a net structure, as shown in FIG. 6. In above mentioned disclosed patents, a net structure is formed by the interweaving of conductive wires. It is not only complicate and time consuming but also because the press connections between wires and between wire and socket can not sustain heavy weight so that it is easy to fall apart or cause bad contact due to pulls while assembled.

SUMMARY OF THE INVENTION

In view of the disadvantage of conventional Christmas lamp socket, an object of present invention is to provide a wiring device with an enhanced net structure for Christmas lamp. Another object of present invention is to provide a wiring device wherein the advantages of time saving, fast and easy in the assembly of a net cell by auxiliary cords and lamp strings can be achieved.

To achieve above and other objects, a wiring device of present invention comprises a plurality sets of lamp string, each of which being a serial connection of a plurality of lamp sockets via conductive wire, the plurality sets of lamp strings being arranged in parallel and connected to each other at side-end. in accordance with present invention, there is a plurality of parallel-arranged high pull-resist nylon auxiliary cords and C-shaped hook elements on side of sockets, said auxiliary cords serially connecting hook elements in a direction perpendicular to the lamp strings to form a interconnected net structure.

According to present invention, both ends of an auxiliary cord are provided with opposite half of a hatch cylinder holder. The hatch cylinder holder has a center receiving space and a side-wall receiving space, wherein the center receiving space clip a socket on the side of auxiliary cord, and the side-wall receiving space firmly fixes the side of the auxiliary to enhance the net structure. Therefore, it is possible to sustain heavy load and provide pull-resistance. Also, the serial connection among auxiliary cords, sockets and cylinder holder is not only fast and easy, but also time saving in assembly and cost saving.

BRIEF DESCRIPTION OF DRAWINGS

The above and other objects, features, and advantages of present invention will become more apparent from the detailed description in conjunction with the following element 21(21') being provided on side of each lamp socket 20(20'), which is C-shaped and has a gap of a size slightly less than the diameter of the auxiliary cords; and a hatch cylinder holder 30(30') mounted on both ends of a corresponding auxiliary cord 102(102'), which allows the auxiliary cords 102(102') to make equal-spaced connection between lamp sockets 20(20') of different strings in a direction perpendicular to that of the plurality sets of lamp string 10(10') via the hook elements and form a interconnected net structure (FIG. 1).

Figure 1:
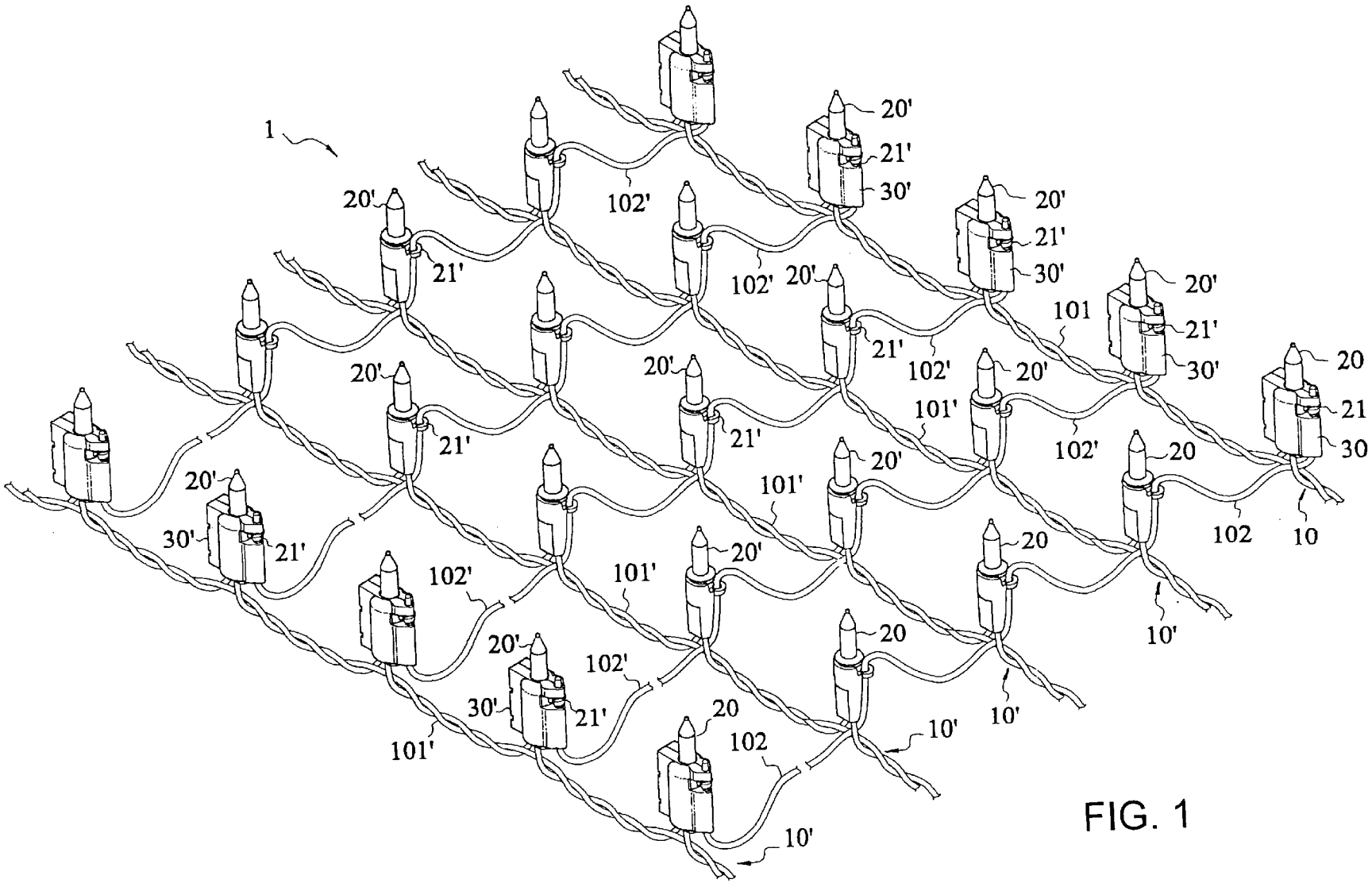
Figure 2:
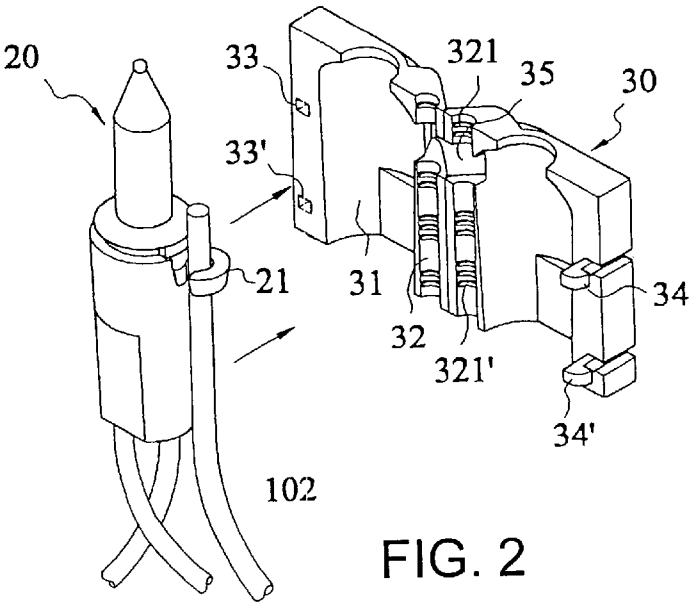
As shown in FIG. 2, with a hook 34(34') buckle into its groove 33(33'), the hatch cylinder holder 30(30') will be closed to form a center receiving space 31 and a side-wall receiving space 32. The center receiving space 31 is a cavity of the shape of the lamp socket 20 and is capable of clipping the auxiliary cord to the side of the lamp socket. The side-wall receiving space 32 is an axial circular bore with a diameter of about that of the auxiliary cord 102(102') and has a plurality of bumps 321(321') on its inner wall. There is also an opening 35 on the upper portion of the space 32 at a position corresponding to the hook element 21 of a lamp socket 20, so that the hook element 21 will protrude from the opening when the hatch cylinder holder 30 is in a closed state. Since the center line of the bore is parallel to that of the hook element 21, so that when the hatch cylinder holder 30 is in a closed state the side-wall receiving space 32 is fixed to the side of the auxiliary cord 102(102') and enhances the net structure. Therefore it is possible to sustain heavy load and provides pull resistance.
Figure 3:
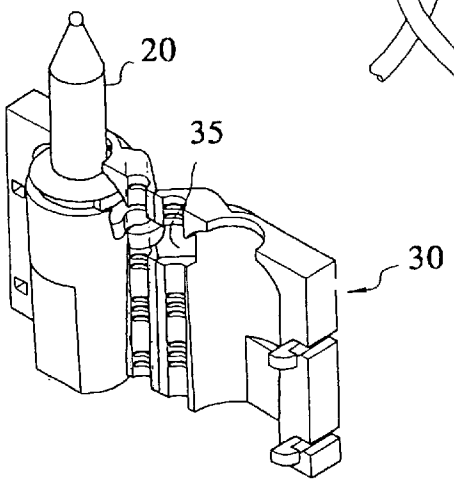
Figure 4:
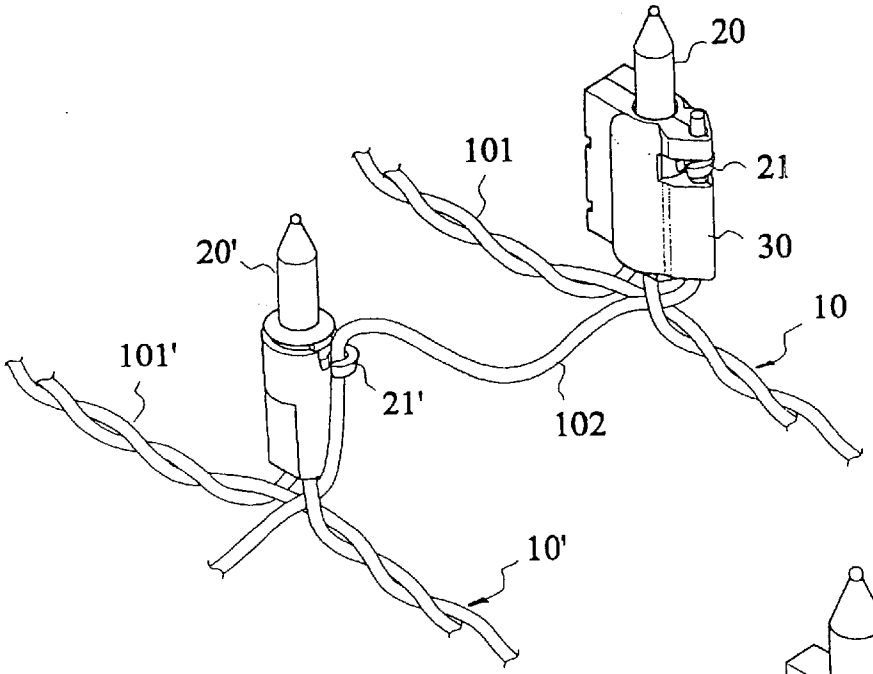
Figure 5:
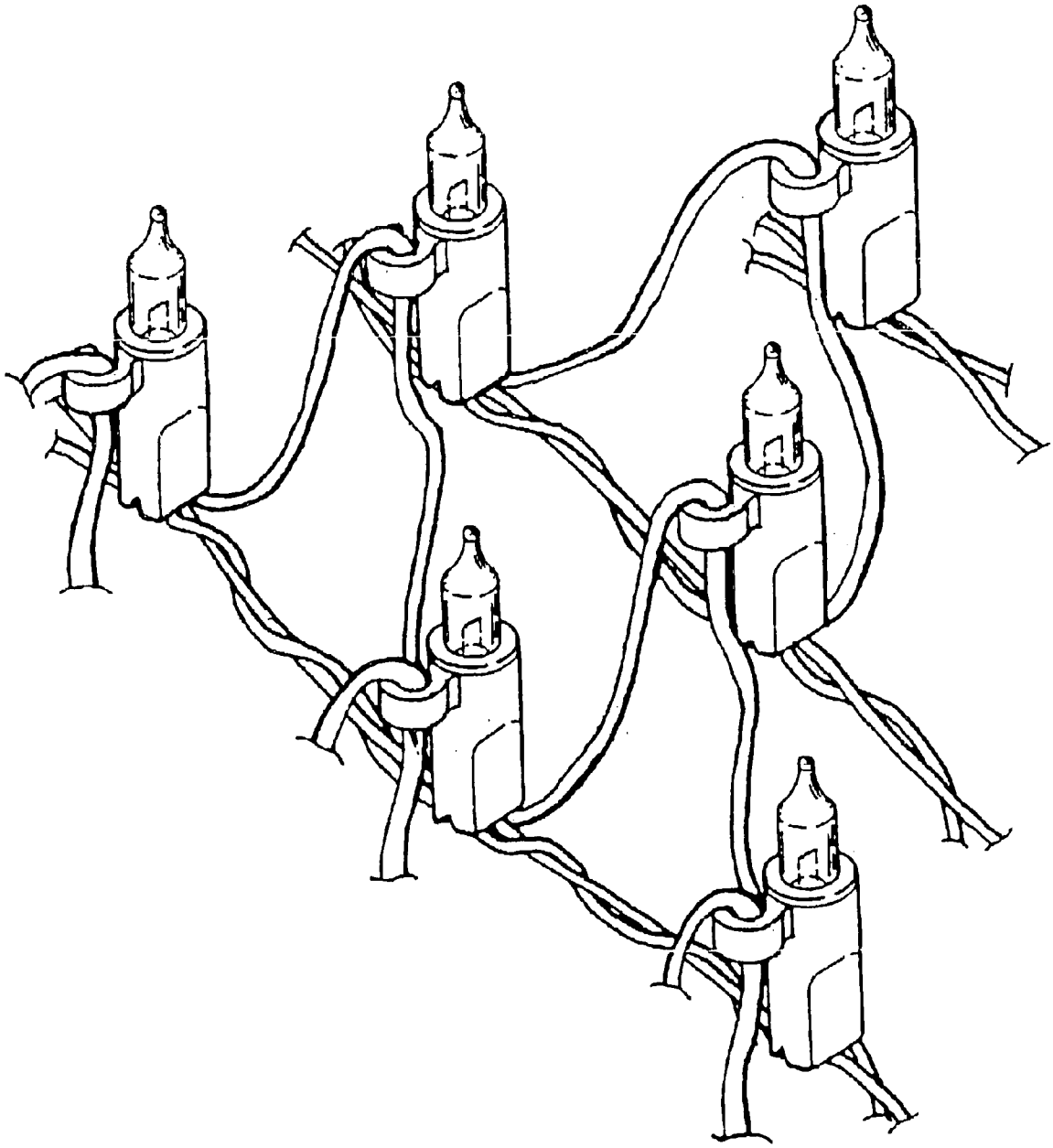
( PRIOR ART ) FIG. 5
Figure 6:
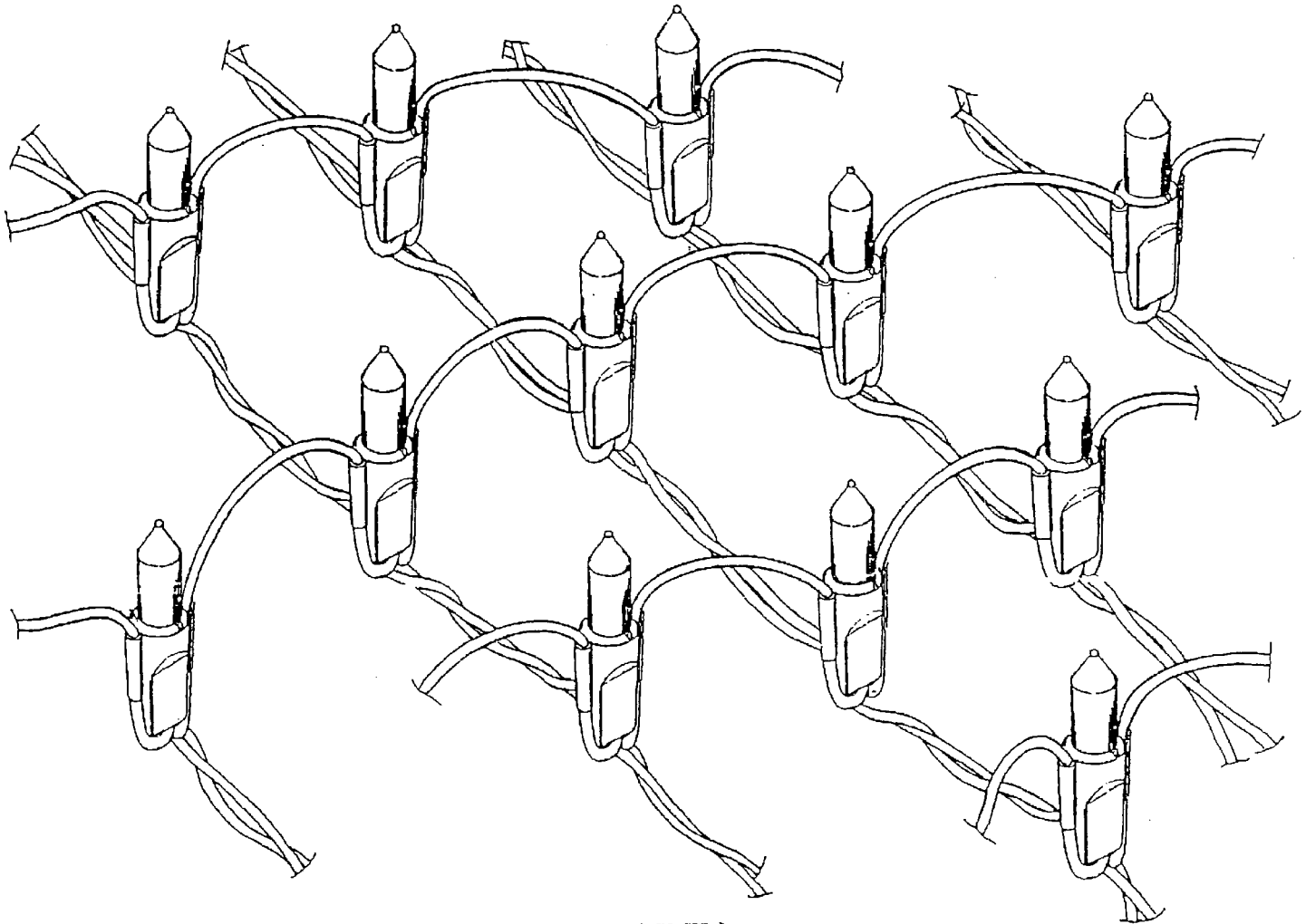
( PRIOR ART ) FIG. 6

According to present invention, a plurality of auxiliary cords 102(102') are used to interweave a plurality sets of lamp string 10(10') into a interconnected net structure, which provides not only a fast, easy, and time saving assembling among auxiliary cords 102(102'), lamp sockets 20(20'), and hatch cylinder holder 30(30') but also lower cost.

While above described are preferred embodiments of the present invention, it is not intended to be the limit of the invention, various change and modification without departing from the claim must be considered within the scope of the invention.

To summary, a wiring device in accordance with present invention uses auxiliary cords to enhance the net structure and prevents the connection between conductive wires or between conductive wires and lamp socket from falling apart or bad contacts caused by pulling, therefore it is a novel and advanced invention with industrial availability.

LIST OF REFERENCE NUMERALS

| numeral | elements |
|---|---|
| 1 | wiring device |
| 10, 10' | lamp string |
| 20, 20' | lamp socket |
| 21, 21' | hook element |
| 30, 30' | hatch cylinder holder |
| 31, 31' | center receiving space |
| 32 | side-wall receiving space |
| 33, 33' | groove |
| 34, 34' | hook |

-continued

| numeral | elements |
|---|---|
| 35 | opening |
| 101, 101' | conductive wire |
| 102, 102' | auxiliary cords |
| 321, 321' | bumps |

What I claimed is:

1. A wiring device comprises a plurality sets of lamp strings, each of which being a serial connection of a plurality of lamp sockets via conductive wire, said plurality sets of lamp strings being arranged in parallel and connected to each other at sides via conductive wires, which is characterized in that:

a plurality of high pull-resist auxiliary cords, arranged parallel to each other and serially connect with a hook element on the side of each lamp socket in each lamp string in a direction perpendicular to the lamp string to form an interconnected net structure; and a plurality of hatch cylinder holders each having a center receiving space and a side-wall receiving space, said center receiving space being adapted to clip an auxiliary cord on the side of a lamp socket by means of a second hook element, and said side-wall receiving space firmly fixing the side of said auxiliary cord to enhance said net structure.

2. The wiring device as et forth in claim 1, wherein said hatch cylinder holder is formed in two parts hingedly connected together, one part having a hook and the other part a corresponding groove so that said hatch cylinder holder can be closed by buckling up said hook with said groove.

3. The wiring device as set forth in claim 1, wherein said center receiving space is a cavity in the shape of said lamp socket.

4. The wiring device as set forth in claim 1, wherein said side-wall receiving space is an axial circular bore with a diameter of about that of said auxiliary cord and having a plurality of bumps on its inner wall.

5. The wiring device as set forth in claim 1, wherein said side-wall receiving space has an opening on its upper portion at a position corresponding to said second hook element of a lamp socket and a center line of said side-wall receiving space is parallel to that of said hook element.

* * * * *